US010441015B2

(12) United States Patent
Niedrich et al.

(10) Patent No.: US 10,441,015 B2
(45) Date of Patent: Oct. 15, 2019

(54) HAT WITH HANGING ELEMENT

(71) Applicant: GameFaceGear LLC, Hailey, ID (US)

(72) Inventors: Douglas Harold Niedrich, Hailey, ID (US); Jeremy D. Cutler, Boise, ID (US)

(73) Assignee: GameFaceGear LLC, Hailey, ID (US)

( * ) Notice: Subject to any disclaimer, the term of this patent is extended or adjusted under 35 U.S.C. 154(b) by 134 days.

(21) Appl. No.: 14/843,758

(22) Filed: Sep. 2, 2015

(65) Prior Publication Data

US 2016/0058089 A1 Mar. 3, 2016

Related U.S. Application Data

(60) Provisional application No. 62/045,306, filed on Sep. 3, 2014.

(51) Int. Cl.
*A42B 1/22* (2006.01)
*A42B 1/06* (2006.01)

(52) U.S. Cl.
CPC ..... *A42B 1/22* (2013.01); *A42B 1/067* (2013.01)

(58) Field of Classification Search
CPC ..... A42B 1/22; A42B 1/067
USPC ..... 2/175.7, 195.1–195.5, 172
See application file for complete search history.

(56) References Cited

U.S. PATENT DOCUMENTS 1,331,701 A 2/1920 Fendelman
1,356,542 A 10/1920 McNeill
1,485,160 A 2/1924 Bassan
1,831,776 A * 11/1931 Nelson ..... A42B 1/24 2/175.7
2,472,033 A 2/1947 Wetzel
2,462,258 A 2/1949 Dannenberg
3,016,545 A 3/1958 Donahue
2,904,052 A * 9/1959 Geiger ..... A42B 7/00 132/57.1
4,662,007 A * 5/1987 Lipkin ..... A42B 1/066 2/172
5,121,507 A * 6/1992 Brown ..... A42B 1/004 2/10
5,201,077 A * 4/1993 Dondlinger ..... A42B 1/067 2/172
5,655,225 A * 8/1997 Mathers ..... A42B 1/067 2/172
5,765,229 A * 6/1998 McLeod ..... A42B 1/062 2/172
6,163,886 A * 12/2000 Carter ..... A42B 1/067 2/172

(Continued)

*Primary Examiner* — Katherine M Moran
(74) *Attorney, Agent, or Firm* — Maschoff Brennan

(57) ABSTRACT

The present disclosure may relate to a hat. The hat may include a cavity with an opening configured to receive a head of a user. The hat may also include an adjustable band around the opening of the cavity that may adjust a volume of the cavity between a first volume and a second volume. The hat may also include a hanging element coupled to the cavity and configured to be substantially concealed within the cavity at either the first volume or the second volume, be substantially disposed outside of the cavity at either the first volume or the second volume, and transition back and forth between being substantially concealed within the cavity and being substantially disposed outside of the cavity at either the first volume or the second volume.

23 Claims, 10 Drawing Sheets

(56) References Cited

U.S. PATENT DOCUMENTS

| | | | | |
|---|---|---|---|---|
| 6,493,880 | B1 * | 12/2002 | Lo | A42B 1/062 2/195.2 |
| 7,831,776 | B2 * | 11/2010 | Mannava | G06F 12/0824 711/144 |
| 2005/0028248 | A1 * | 2/2005 | Yan | A42B 1/22 2/195.3 |
| 2006/0174397 | A1 * | 8/2006 | Taguchi | A42B 1/062 2/195.6 |
| 2007/0163028 | A1 * | 7/2007 | Brauner | A42B 7/00 2/175.7 |
| 2007/0192934 | A1 | 8/2007 | Niedrich et al. | |
| 2009/0193564 | A1 | 8/2009 | Niedrich et al. | |
| 2015/0057621 | A1 * | 2/2015 | Coombs | A42B 1/18 604/289 |

* cited by examiner

HAT WITH HANGING ELEMENT

FIELD

The embodiments discussed herein are related to a hat.

BACKGROUND

Hats can have a wide range of designs to meet the fashion desires of the wearer while also serving one or more functional needs such as protection from the environment. For example, hats are commonly worn as protection from the sun and/or as a particular type of fashion statement.

The subject matter claimed herein is not limited to embodiments that solve any disadvantages or that operate only in environments such as those described above. Rather, this background is only provided to illustrate one example technology area where some embodiments described herein may be practiced.

SUMMARY

One or more embodiments of the present disclosure may relate to a hat. The hat may include a cavity with an opening configured to receive a head of a user. The hat may also include an adjustable band around the opening of the cavity that may adjust a volume of the cavity between a first volume and a second volume. The hat may also include a hanging element coupled to the cavity and configured to be substantially concealed within the cavity at either the first volume or the second volume, be substantially disposed outside of the cavity at either the first volume or the second volume, and transition back and forth between being substantially concealed within the cavity and being substantially disposed outside of the cavity at either the first volume or the second volume.

The object and advantages of the embodiments will be realized and achieved at least by the elements, features, and combinations particularly pointed out in the claims. It is to be understood that both the foregoing general description and the following detailed description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
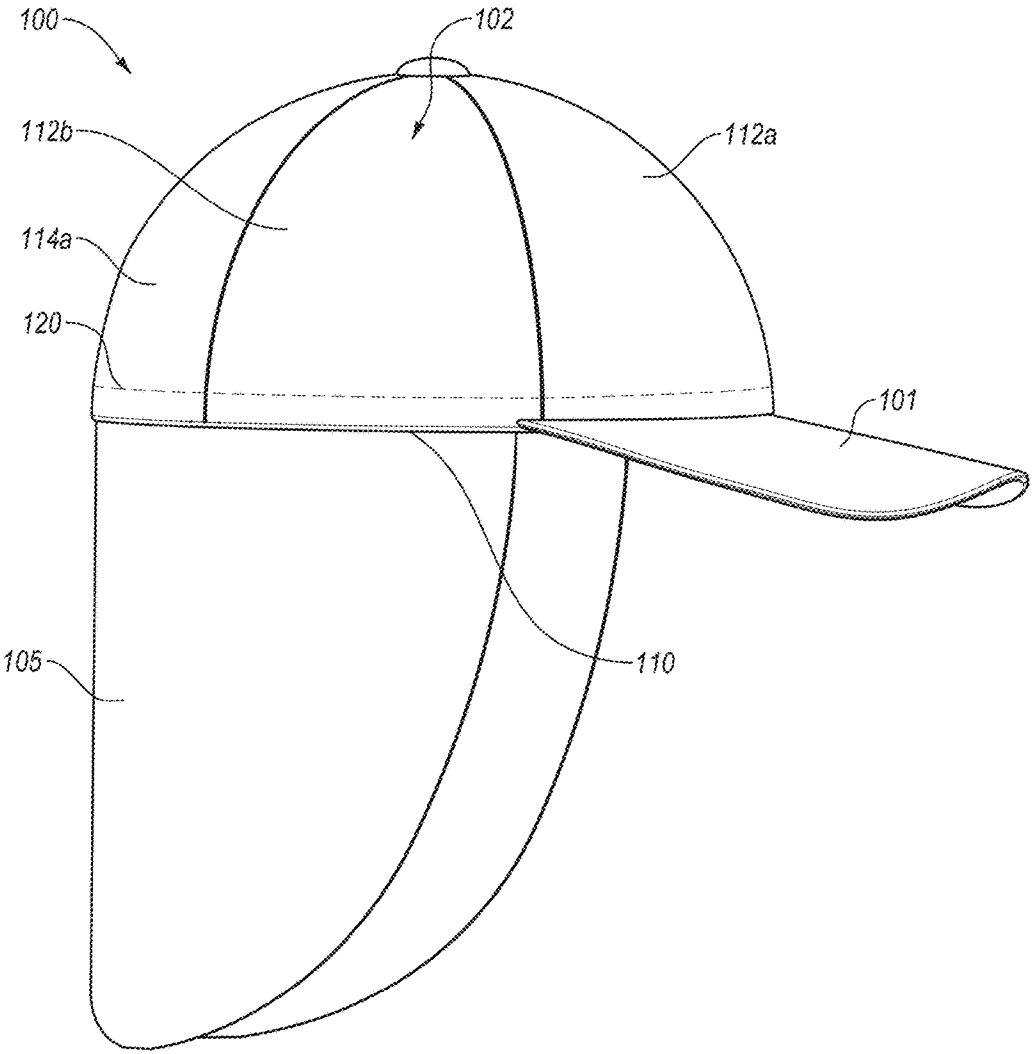
FIG. 1*a* illustrates an example embodiment of a hat viewed from the side with a hanging element unconcealed.

In addition to fashion, people often wear articles of clothing on their heads. These articles of clothing are commonly referred to as "hats" and may be configured to be many different shapes and sizes. Hats may be worn to protect the head of a user from the environment. Different hat configurations may protect the user from environmental elements such as sun exposure, wind, rain, snow, cold, or heat. For example, a long hat brim may shield eyes of the user from direct sunlight. Additionally or alternatively, some hats may include masks that may be used by the user. For example a mask may hang from a hat that may hide part of the user. A number of mask types may be used for many situations. For example the mask may be configured as a costume for the user. As another example, the mask may be camouflaged and used by the user to better blend in with his surroundings (e.g., while hunting, bird watching, photographing and/or observing nature/wildlife in general, and/or for military, tactical, or special operations).

A common problem associated with many common hats is the environment may change while the user is using the hat. As the environment changes, the user may desire to change the configuration of the hat. For example, the user may desire to change configuration for reasons of fashion, to adapt the protection provided by the hat, or to conform to the new environment. For example, in sunny weather a hat user may desire to protect his neck from prolonged sun exposure and may desire to wear a hat with a shade cloth attached to the back of the hat. However, if the sunny weather changes to dark and overcast, the shade cloth may become burdensome or fashionably undesirable in the new environmental condition.

Independent from the environment, an additional problem associated with hats may be that the situation or circumstances in which the user is using the hat may change while the user is using the hat. As the situation changes the user may desire to change the configuration of the hat to meet the demands of the new situation. For example, while hunting, a user may desire to camouflage his face by using a mask which may be attached to a hat. However, if the user no longer desires to hunt or be camouflaged the mask may become burdensome or fashionably undesirable outside of the hunting situation.

A second of many possible examples may include situations involving costumes. In some situations, costumes may be fashionably unacceptable. However, other situations may provide for an acceptable use of costumes. As a user transitions from an acceptable costume situation to an unacceptable costume situation, a user using a hat configured with a mask may desire to change the configuration of the hat to meet the demands of the new situation. For example, a user may be attending a costume party and may desire to use a mask which may be attached to a hat. If the user leaves the costume party, the mask may become burdensome or socially undesirable in the new situation.

As such, as detailed below, according to one or more embodiments of the present disclosure, a hat that includes a hanging element (e.g., a sunshade, a mask, etc.) may be configured in a manner that a user may more easily change the configuration of the hat to better suit a new environmental or situational condition.

Embodiments of the present disclosure will be explained with reference to the accompanying drawings.

FIG. 1*a* illustrates a side view of an example embodiment of a hat 100 including a concealable hanging element 105 arranged according to at least one embodiment of the present disclosure. The hat type used in the example embodiment is commonly referred to as a "baseball" hat. The present disclosure is not limited to baseball hats and can be used in any number of different hat types.

Figure 1B:
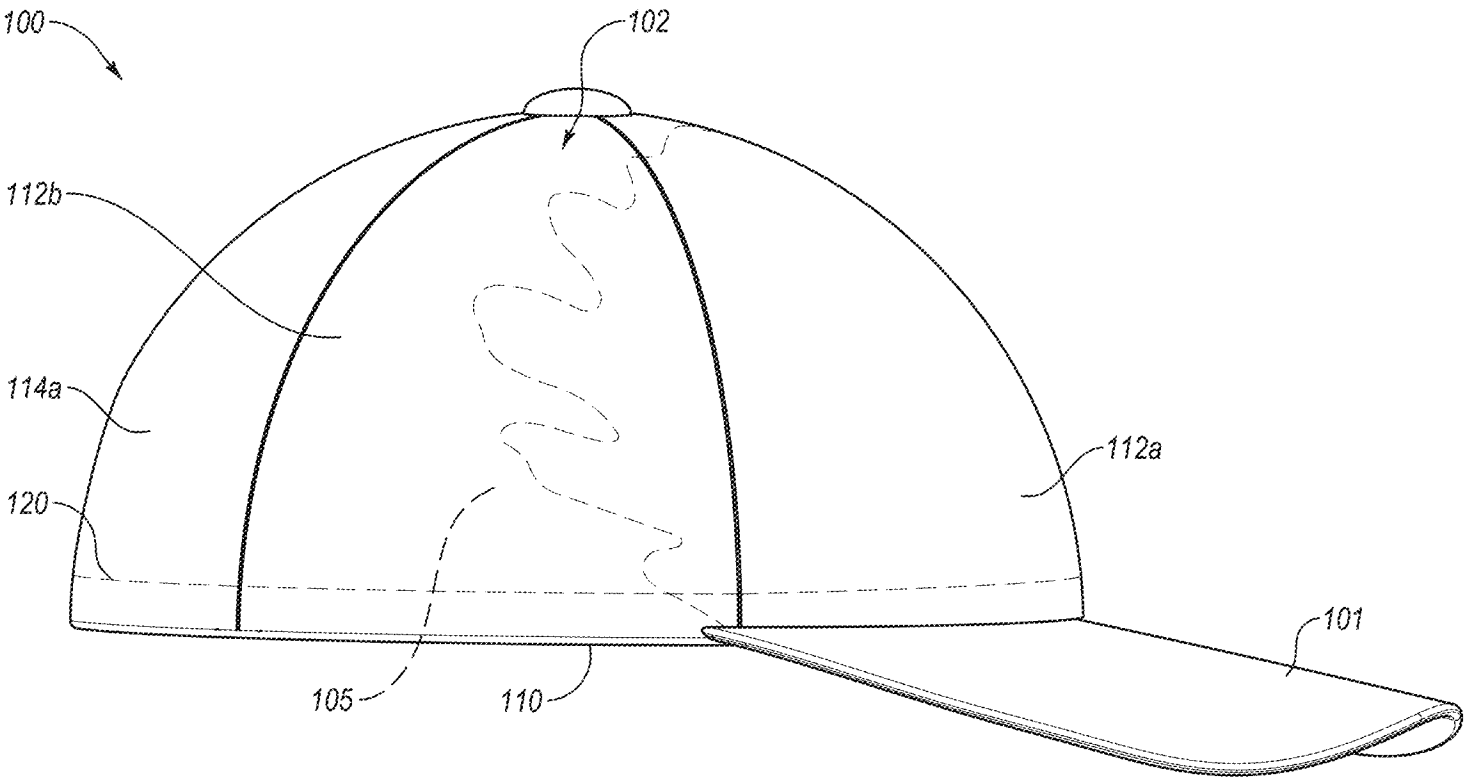
FIG. 1*b* illustrates the hat of FIG. 1*a* viewed from the side with the hanging element concealed within the hat.
Figure 1C:
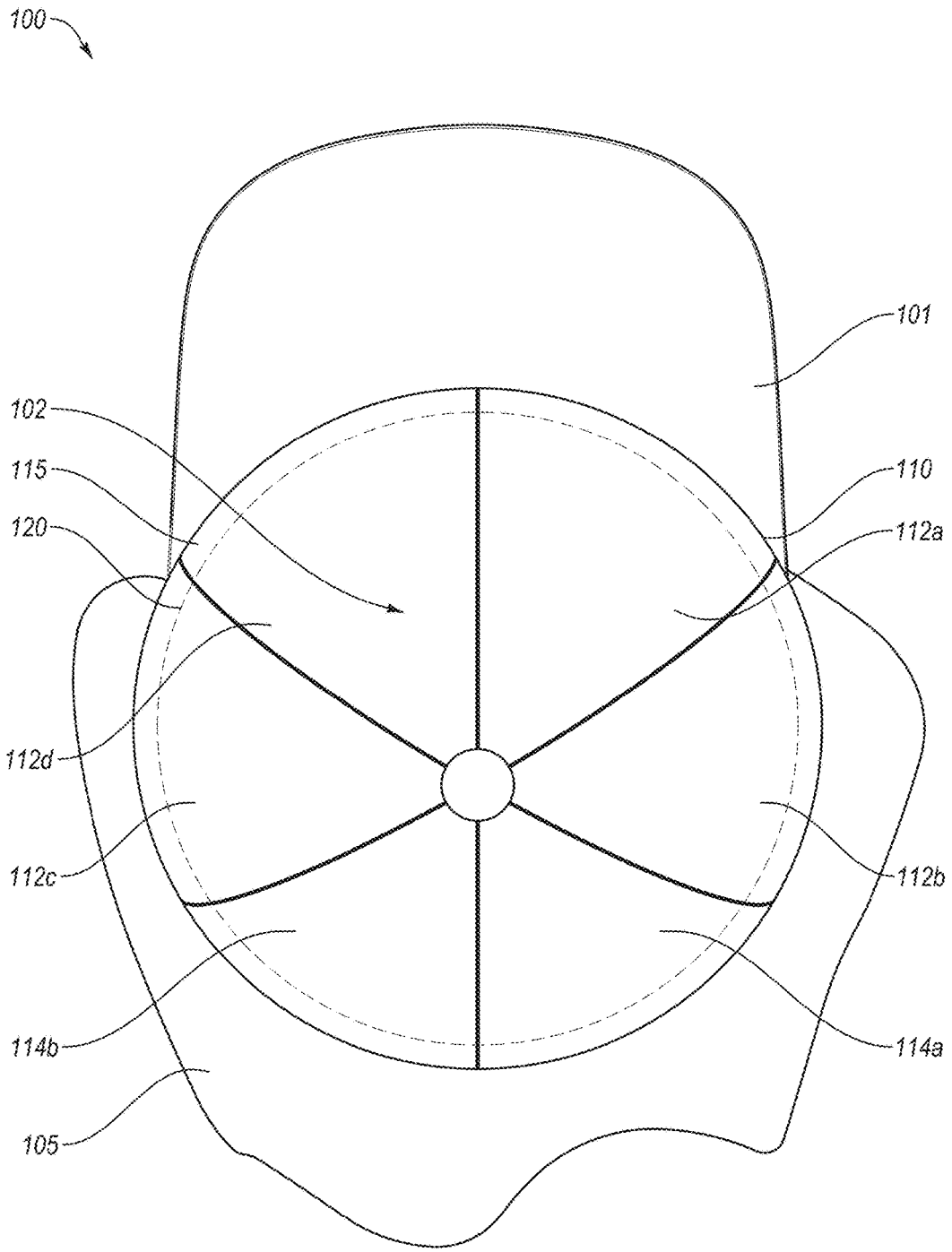
FIG. 1*c* illustrates the hat of FIG. 1*a* viewed from below.
Figure 2:
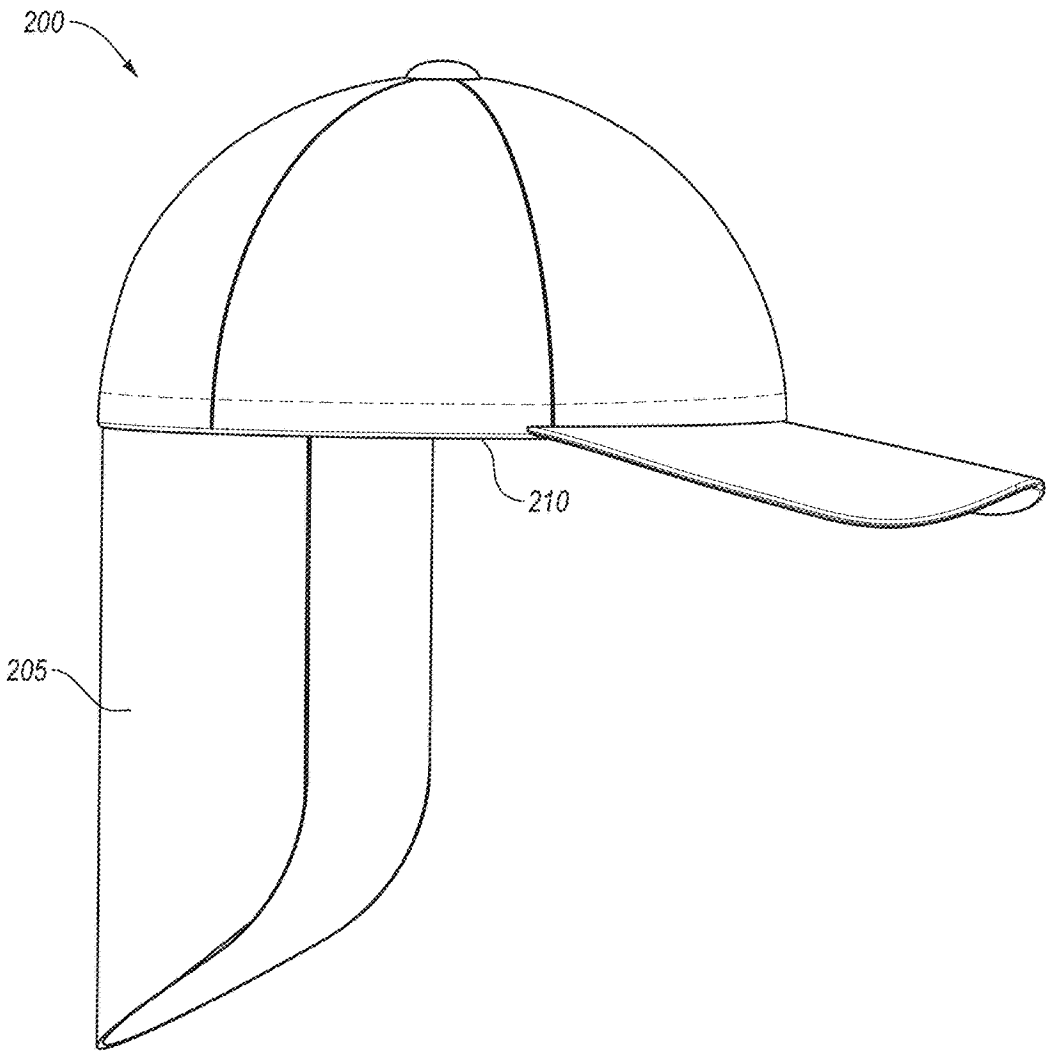
FIG. 2 illustrates another example embodiment of a hat viewed from the side.
Figure 3:
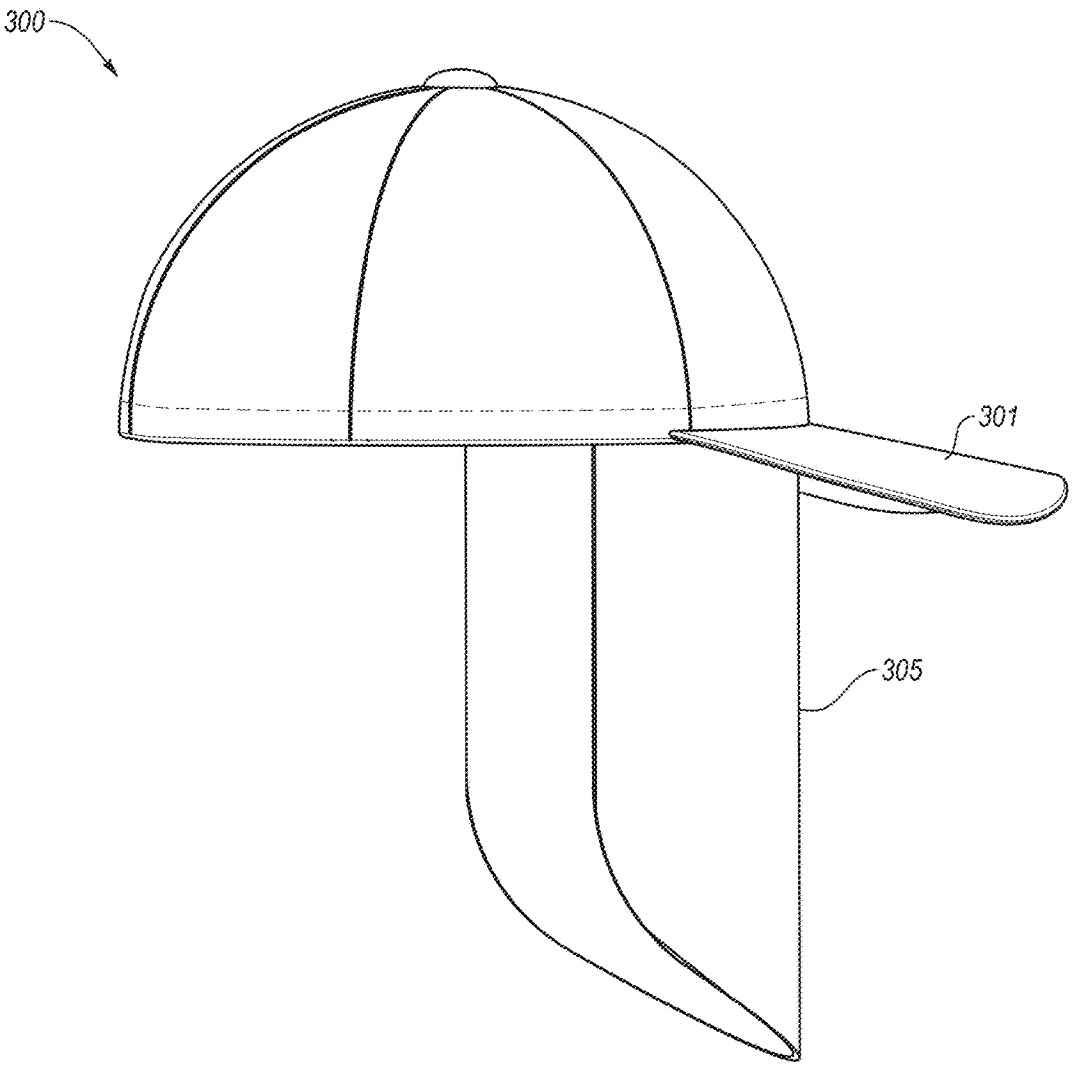
FIG. 3 illustrates another example embodiment of a hat viewed from the side.

The illustrated embodiment of FIG. 1*a* depicts the hat 100 from the side with a hanging element 105 unconcealed. FIG. 1*b* depicts the hat 100 from a side view with the hanging element concealed. FIG. 1*c* depicts the hat 100 from below. FIG. 2 depicts a hat 200 viewed from the side that may have one or more of the same features as a hat 100 and a different embodiment of the hanging element 205. FIG. 3 depicts a hat 300 viewed from the side that may have one or more of the same features as the hat 100 and a different embodiment of a hanging element 305.

The hat 100 may include a hanging element 105 (illustrated in FIGS. 1*a*-1*c*), a rim 110 (illustrated in FIGS. 1*a*-1*c*), one or more panels 112 (illustrated in FIGS. 1*a*-1*c*), one or more variable panels 114 (illustrated in FIGS. 1*a*-1*c*), an adjustable band 115 (illustrated in FIG. 1*c*), a securing mechanism 120 (illustrated in FIGS. 1*a*-1*c*), a cavity 102 with an opening (illustrated in FIGS. 1*a*-1*c*), and a bill 101 (illustrated in FIGS. 1*a*-1*c*). In some embodiments, the hanging element 105 may be configured to collapse within the cavity 102 in a manner that allows the hanging element 105 to be quickly and easily hidden within the cavity 102 when a user desires to wear the hat 100 without the hanging element 105 substantially showing. For example, as detailed below, the hat 100 and the hanging element 105 may be configured such that the user of the hat 100 illustrated in FIGS. 1*a*-1*c* may grasp the bill 101 in one hand and flip the hanging element 105 above the rim 110 so a substantial part of the hanging element 105 nests within the cavity 102; the user may then wear the hat with the substantial portion of the hanging element 105 residing inside the cavity 102 and substantially concealed within the rim 110 as depicted in FIG. 1*b*. Additionally or alternatively, the hanging element 105 and the hat 100 may also be configured such that the hanging element 105 may quickly and easily fall out of the cavity 102 when the user desires that the hanging element 105 be visible and used outside of the cavity of the hat 100.

The cavity 102 may be configured to receive the head of the user. In some embodiments, the cavity 102 may be formed by any number of the panels 112 and/or the variable panels 114. The panels 112 and/or the variable panels 114 may be configured to delineate any portion of the hat 100 in any number of sections. For example, as illustrated in FIG. 1*c*, the hat 100 may include panels 112*a*, 112*b*, 112*c*, 112*d*, and variable panels 114*a* and 114*b*, which may be configured as triangles that may form the cavity 102 of the hat 100. The number of the panels 112 and/or the panels 114 may vary and may be more or fewer than six in some embodiments. Additionally or alternatively, the shape of the panels 112 and/or the variable panels 114 may vary. For example, in some embodiments, the panels 112 may form a part of the cavity 102 and the variable panels 114 may form the remainder of the cavity 102. Additionally or alternatively, the panels 112 may form substantially the entire cavity 102 or the variable panels 114 may form substantially the entire cavity 102.

In some embodiments, one or more of the variable panels 114 may be reinforced. The reinforced variable panels 114 may be disposed such that they are in proximity to where a substantial portion of the hanging element 105 may be nested within the cavity 102. The additional rigidity provided by the reinforced variable panels 114 may allow the hanging element 105 to more easily fall into and rest in the cavity 102 when it is desired that the hanging element 105 be concealed. For example, in the illustrated embodiment depicted in FIG. 1*c*, the panels 114*a* and 114*b* may be composed of a reinforced material because the hanging element 105 is disposed around the back of the hat 100 and the reinforced variable panels 114*a* and 114*b* are also used to form the back of the cavity 102. In these and other embodiments, one or more of the reinforced variable panels 114 may include a gradation of reinforcement. For example, one or more of the reinforced variable panels 114 may be configured to be substantially ridged near the center of the reinforced panels and may gradually become less ridged at distances farther away from the center of the reinforced variable panels 114, or vice versa. Any other mechanism of reinforcement may also be used, such as treating a material with starch, adding additional layers of material, adding filaments, fibers, etc. to the material, including patterns (such as ridges, whirls, loops, studs, hash-marks, etc.) in the material, stitching the material, etc. Additionally or alternatively, a material may be selected that includes reinforcement, such as ridges, whirls, loops, studs, hash-marks, etc.

In some embodiments, the material for the panels 112, the variable panels 114, and/or the hanging element 105 may be selected with specific purposes. The material for each of the panels 112, the variable panels 114, and the hanging element 105 may be selected independently of the others, or there may be some dependence between the type(s) of materials selected. For example, any of the material(s) may be selected to facilitate the hanging element 105 transitioning between being substantially disposed within the cavity 102 and being substantially outside of the cavity 102. As another example, any of the materials may be selected to facilitate the cavity 102 changing volume to better fit the head of the user. As an additional example, the materials may be selected such that the hanging element 105 maintains the ability and/or configuration to transition between being substantially disposed within the cavity 102 and being substantially outside the cavity 102 even if the cavity 102 has changed volume to better fit the head of the user. For example, if the cavity 102 were at either a first volume or a second volume, the hanging element 105 may maintain the ability and/or configuration to transition between being substantially disposed within the cavity 102 and being substantially outside of the cavity 102.

In these and other embodiments, the materials may be selected so that a material has elastic properties such that the material expands from a resting length to approximately between 1.0 and 2.0 times the resting length of the material. The range provided is merely illustrative, and any value of expansion may be used, such as 1.1, 1.5, 1.9, etc. times the resting length. Additionally or alternatively, the retractive aspect of the elastic properties of the material may be considered. For example, a material may have a high expansion, allowing for large sized heads to fit within the cavity, but if the material retracts with an exceptional high force, the hat may be uncomfortable. Thus, the retractive force of a material may also be considered in selecting a material.

In some embodiments, a material may be biased such that the material has greater elastic properties in one direction than in another, for example, a panel 112 and/or a variable panel 114 may expand parallel to the rim 110 to a ratio of between approximately 1.1 and 1.4 times the resting length and may expand perpendicular to the rim 110 to a ratio between approximately 1.0 and 1.1 times the resting length. In these and other embodiments, the material of the hanging element 105 may be selected and/or coupled with the cavity 102 to align with the bias of the material of the panel 112 and/or the variable panel 114. For example, if the cavity 102 is formed of panels 112 and/or variable panels 114 using material that may be expandable parallel to the rim 110 to a ratio of about 1.2 times the resting length, the material for the hanging element 105 may be selected of a material that is also expandable parallel to the rim 110 to a ratio of about 1.2 times the resting length.

Additionally or alternatively, if the cavity 102 is formed of panels 112 and/or variable panels 114 using material that may be expandable parallel to the rim 110 to a ratio of about 1.2 times the resting length, the material for the hanging element 105 may be selected of a material with low elastic properties (e.g. expanding to a ratio of about 1.0 to 1.1 times the resting length) and may include pleats, plaits, ruffles, fold-overs, etc. in the material such that as the panels 112 and/or the variable panels 114 expand, the pleats, plaits, ruffles, fold-overs, etc. may at least partially straighten out to facilitate aligning with the expansion of the cavity 102. Additionally or alternatively, the panels 112 and/or the variable panels 114 may be made of less elastic material and include pleats, plaits, ruffles, fold-overs, etc. and the hanging element 105 may be made of a more elastic material such that as the hanging element 105 is expanded, the pleats, plaits, ruffles, fold-overs, etc. may be at least partially straightened out. Additionally or alternatively, a less elastic material may include a slit, void, or other gap in the material to align the material with the expansion of another more elastic material to which the less elastic material is coupled. While some examples provided may include material with different elastic properties in different directions, the principles described with respect to selecting materials to align expansion, selecting pleats, plaits, ruffles, fold-overs, etc. are also applicable to any material selection, regardless of directionality of elastic properties.

In some embodiments, the material of one or more of the panels 112, the variable panels 114, and/or the hanging element 105 may include, by way of non-limiting example, any of nylon (including any variations of nylon), spandex, lycra, elastane, cotton, polyester, cotton blends (including with spandex, polyester, etc.), silver threads, etc. or combinations or blends thereof. In these and other embodiments, materials may be selected and/or treated to have specific properties, for example, flexibility, sun protection, water repellant or water proof properties, fire retardant properties, anti-bacterial properties, anti-microbial properties, temperature regulation, moisture control properties, moisture wicking properties, far-infrared shielding or enhancing properties, etc. In these and other embodiments, any of these properties may be achieved by treating the material with a treatment, for example, with an anti-microbial or anti-bacterial treatment (including silver ions/nano technology), with a sun protection treatment (including protection from UVA/UVB rays, or a sun protection factor (SPF) of ten to fifty), etc. In some embodiments, the material may have a fabric weight of between approximately ten grams per square meter and five hundred grams per square meter. In some embodiments, the material may have a fabric weight of about one hundred and eighty grams per square meter.

The adjustable band 115 may be attached anywhere at or above the rim 110 in a matter suitable for hat use. In some embodiments, the hanging element 105 may be disposed under the adjustable band 115 such that the hanging element 105 may be disposed between the adjustable band 115 and the panels 112 and/or the variable panels 114 with which the hanging element 105 may be associated. In these or other embodiments, the adjustable band 115 may be attached such that the bottom edge of the adjustable band 115 may be above the rim 110 suitable for concealing the presence of the hanging element 105 when the hanging element 105 is nested inside the cavity 102. For example, the adjustable band 115 may be attached such that the bottom edge of the adjustable band 115 is at least approximately 1/32 of an inch above the rim 110 with the hanging element 105 disposed under the adjustable band 115. Such a configuration may allow the rim 110 to conceal the folded edge of the hanging element 105 when the hanging element 105 is nested inside the cavity 102. The distance between the bottom of the adjustable band 115 and the rim 110 may vary depending on the thickness of the hanging element 105. For example, the distance may be greater when the hanging element 105 is a relatively thick material as compared to a relatively thin material because the fold may be thicker and larger.

In some embodiments, the adjustable band 115 may be disposed such that the bottom of the adjustable band 115 may be substantially even with the rim 110 and the hanging element 105 may be attached to the adjustable band 115 such that the adjustable band 115 may be between the hanging element 105 and the associated panels 112. In some of these embodiments, the hanging element 105 may be attached above the rim 110 such that the hanging element 105 and the folded edge of the hanging element 105 may be concealed when the hanging element 105 is nested inside the cavity 102.

In some embodiments, the location of the adjustable band 115 may be inconsequential with respect to the placement of the hanging element 105 because the hanging element 105 may be attached to, below, or above the adjustable band 115.

The hanging element 105 may be coupled to any portion of the cavity 102. Additionally or alternatively, the hanging element 105 may be configured to any length, width, thickness, material, and shape suitable for hanging from the hat 100 and nesting within the cavity 102. For example, the illustrated embodiment in FIGS. 1*a*-1*c* depict a hanging element 105 that may be made from a light weight fabric shaped in an elongated circle that extends around the hat 100 to the brim 101 of the hat 100. Additionally or alternatively, the hanging element 105 is configured to be long enough to cover the neck of the user. Furthermore, the size and shape of the hanging element 105 may allow for the hanging element 105 to nest inside the cavity 102 while being worn.

In some embodiments, the hanging element 105 may traverse any distance along the rim 110, for example, a third, half, or the entire distance along the rim 110. Additionally or alternatively, the hanging element 105 may be located in any position relative to the rim 110. For example, FIG. 2 illustrates a hat 200 with a hanging element 205 that may traverse approximately half of a rim 210 of the hat 200. Further, as another example, FIG. 3 illustrates a hat 300 with a hanging element 305 that may be oriented in the front of the hat 300 under a bill 301 of the hat 300.

Returning to FIGS. 1*a*-1*c*, modifications can be made to the hat 100 without changing the scope of the disclosure. The general design of the hat 100 may include many common hat shapes including baseball, "beanie," "boonie," "cowboy," or any other hat design that may be desirable. Also the hanging element 105 may include shapes such as square, triangle, rectangle, or any other shape that may be desired. The hanging element 105 may include a void of any shape, size, or number. For example, the hanging element 105 may include eye holes suitable for increasing visibility through the hanging element 105. In other embodiments, the hanging element 105 may be composed of any material suitable to allow a person increased visibility when looking through the hanging element 105. For example, the hanging element 105 may be composed of sheer material. Additionally or alternatively, hanging element 105 may include any other addition that may be desirable for fashion or protection from the environment.

In some embodiments, the hat 100 and the hanging element 105 may be composed of fabric, waterproof material, or any other suitable material. The hat 100 may include a number of colors suitable to any number of activities for hat wear such as sporting events, hiking, fishing, hunting, or any other event desirable for hat use. There is no requirement for the individual components of the hat 100 to be made of the same material; the individual components may include differing materials. Additionally or alternatively, the exterior and the interior of the hat 100 may be textured to include patterns, designs, trademarks, names, logos, or any other design according to preference.

In some embodiments, additional elements or devices may be added to the hanging element 105 and/or other areas of the hat 100 for a particular use. For example, leaf-shaped material pieces such as artificial leaves may be coupled to the hat 100 to improve a camouflaged appearance. Such additional elements or devices may protrude out and away from the hat 100, providing a three-dimensional element to a visual feature of the hat, such as camouflage or a costume. As another example, if the hat 100 were for a sporting event, the additional elements may be appendages of a mascot or other character visually depicted as part of the hat 100.

In some embodiments, the adjustable band 115 may be composed of a number of materials suitable for hat use and fitting. For example, the adjustable band 115, the panels 112, and/or the variable panels 114 may include a stretchable material suitable for fitting to a variety of users. Allowing for a stretchable material to provide the same device to fit a variety of devices is commonly known as "one-size-fits-most." In these and other embodiments, the securing mechanisms 120 may be configured to secure the hanging element 105 to the hat 100, suitable for maintaining one-size-fits-most capability. In these and other embodiments, the selection of the material for the adjustable band 115, the panels 112, the variable panels 114, and/or the hanging element 105 may include any of the considerations described in the present disclosure, such as aligning expansion of materials, maintaining the transition of the hanging element 105 from being disposed substantially within the cavity 102 to being substantially outside of the cavity 102, etc. In some embodiments, the adjustable band 115 may be part of one of the panels 112 or the variable panels 114. Additionally or alternatively, the adjustable band 115 may be an additional panel proximate the rim 110 of the hat 100. In some embodiments, the adjustable band 115 may include a stretchable cord coupled with a sweat band, or a flat elastic band coupled with a sweat band. In these and other embodiments, the adjustable band 115 may include any combination of the configurations, materials, connections, etc. of the present disclosure.

Figure 4:
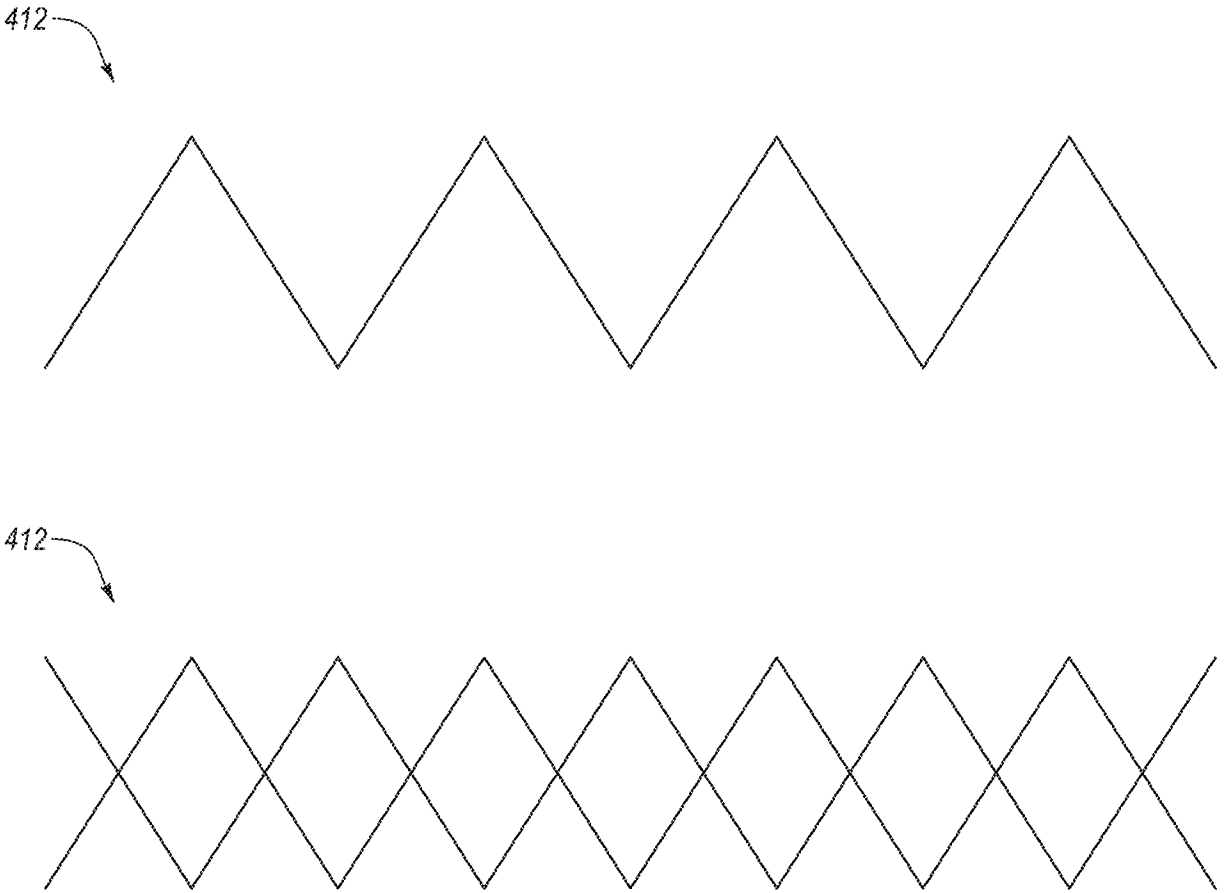
FIG. 4 illustrates examples stitching patterns.

Embodiments using stitching such as the securing mechanism 120 may use any number of different stitching patterns. In further embodiments the stitching pattern may be configured to reduce stretching resistance of the adjustable band 115. For example, the stitching patterns illustrated embodiment in FIG. 4 may be used when the securing mechanism 120 includes stitching. The stitching pattern may allow the material to be stretched with reduced resistance in the direction of the stretching, based on the stitching pattern. For example, the orientations of the cross pattern 411 and the zig-zag pattern 412 may allow for reduced lateral resistance of lateral stretching. In these and other embodiments, a flexible or elastic thread may be used. Additionally or alternatively, a rigid or semi-rigid thread may be used.

In addition, the hanging element 105 may be configured to reduce restrictions on the adjustable band 115. For example, the hanging element 105 may be composed of a stretchable material suitable for reducing restrictions on the adjustable band 115 that may be suitable for providing the hat 100 with adjustable sizes.

Modifications can be made to the band 115 without departing from the scope of the present disclosure. The band 115 may be composed of a variety of different materials suitable for fitting the hat 100 to various sizes. For example, the band 115 may be sized by methods such as VELCRO®, adjustable straps, snaps, buttons, elastic, drawstrings, or any other method suitable for adjusting the band 115 to the user. Furthermore, the band 115 is not limited to adjustable materials, but may also be composed of a pre-sized, non-adjustable material.

In some embodiments, the hanging element 105 may be attached to the adjustable band 115 in a manner suitable for adjusting the hat 100 to a desired size such as buttons, clasps, VELCRO®, or any other mechanism suitable for attaching the hanging element 105 to the adjustable band 115. In these and other embodiments, the attachment may be a temporary or reusable attachment such that the hanging element 105 may be attached to the hat 100 when desired and may be removed when desired. Embodiments that use stitching may include any number of stitching patterns suitable for attaching the hanging element 105 to band 115.

Figure 5:
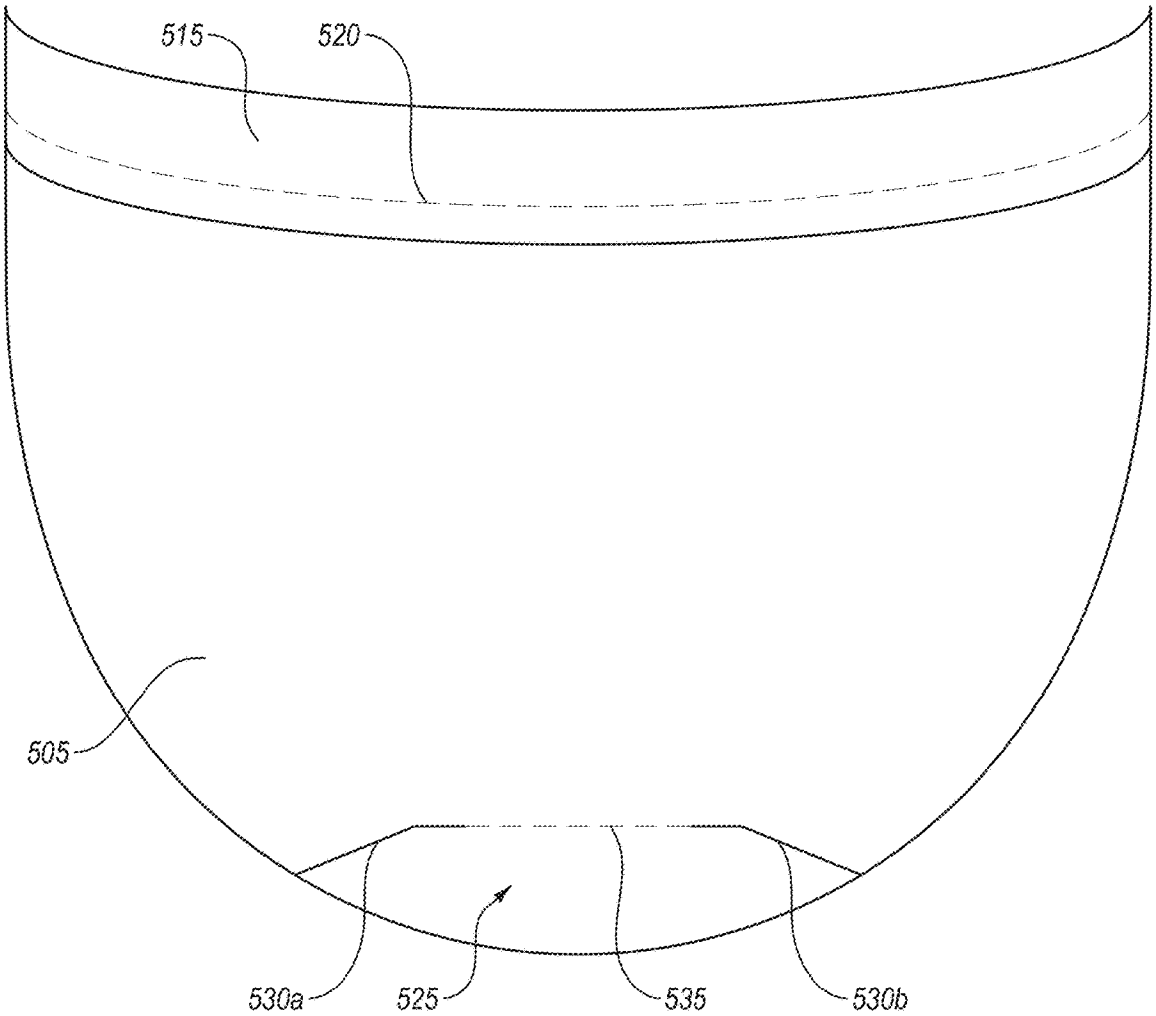
FIG. 5 illustrates an example embodiment of a hanging element viewed from the interior of an embodiment of a hat.

The illustrated example of the hanging element 105 is merely one of many possible embodiments of the hanging element 105. Specific implementations may vary depending on the design of the hat 100 and desired use of the hanging element 105. For example, FIG. 5 illustrates an example embodiment of a hanging element 505 according to at least one embodiment described herein. The hanging element 505 may be coupled to an adjustable band 515 by a securing mechanism 520.

The hanging element 505 may further include one or more pockets 525. The pocket 525 may be formed by a number of methods including one or more seams 530. For example, in the illustrated example depicted in FIG. 5, the pocket 525 may be formed by seams **530*a* and 530*b*. A variety of number, shape, length, thickness, and/or size of seams 530 may form the shape of a pocket 525 that may be symmetric, uniform, asymmetric, disuniform or any other pattern desired. The pocket 525 may be configured to house any number of objects suitable for providing additional weight to the hanging element 505, or may serve merely as a storage location for the user. Examples of such objects may include metal weights, plastic frames, or objects the user may desire to store, such as credit cards, driver's license, key, coins, pens, pencils, lip balm, medication, sunblock, duck calls, turkey calls, other game calls, sports novelties, sports souvenirs, or any other item a person may desire to house in the pocket 525**.

The pocket 525 may be located at any suitable position on the hanging element 505. For example, the pocket 525 may traverse substantially an entire edge of the hanging element 505 and may house a weight. The weight may include any object of any weight, such as a wire, a sand pouch, an additional layer or layers of material or stitching, a metal slug, a plastic band, plastic pellets, etc. In these and other embodiments, the weight may be selected and/or configured to facilitate the hanging element 505 transitioning from being disposed substantially within a cavity of a hat to the hanging element 505 being disposed substantially outside of the hat. For example, the weight may provide additional momentum to an end of the hanging element 105 when being swung into the cavity and may provide additional gravitational force to the end of the hanging element 105 when being dropped out of the cavity. Additionally or alternatively, any number of pockets 525 may be fixed to the hanging element 505, and any of the pockets 525 may be located at any location on the hanging element 505.

In some embodiments, the pocket 525 may include a securing device 535 configured to allow objects to be substantially secured within the pocket 525. For example, the securing device 535 may include buttons, snaps, clasps, zippers, adhesives, pins, stitching, VELCRO®, magnets, or any other method suitable for substantially securing an object within the pocket 525.

In some embodiments, the pocket 525 may include multiple sizes and/or layers of compartments. By way of non-limiting example, there may be a first layer with a large pocket and a second layer with two smaller pockets. Any number of layers, sizes, and/or pockets may be used.

Figure 6:
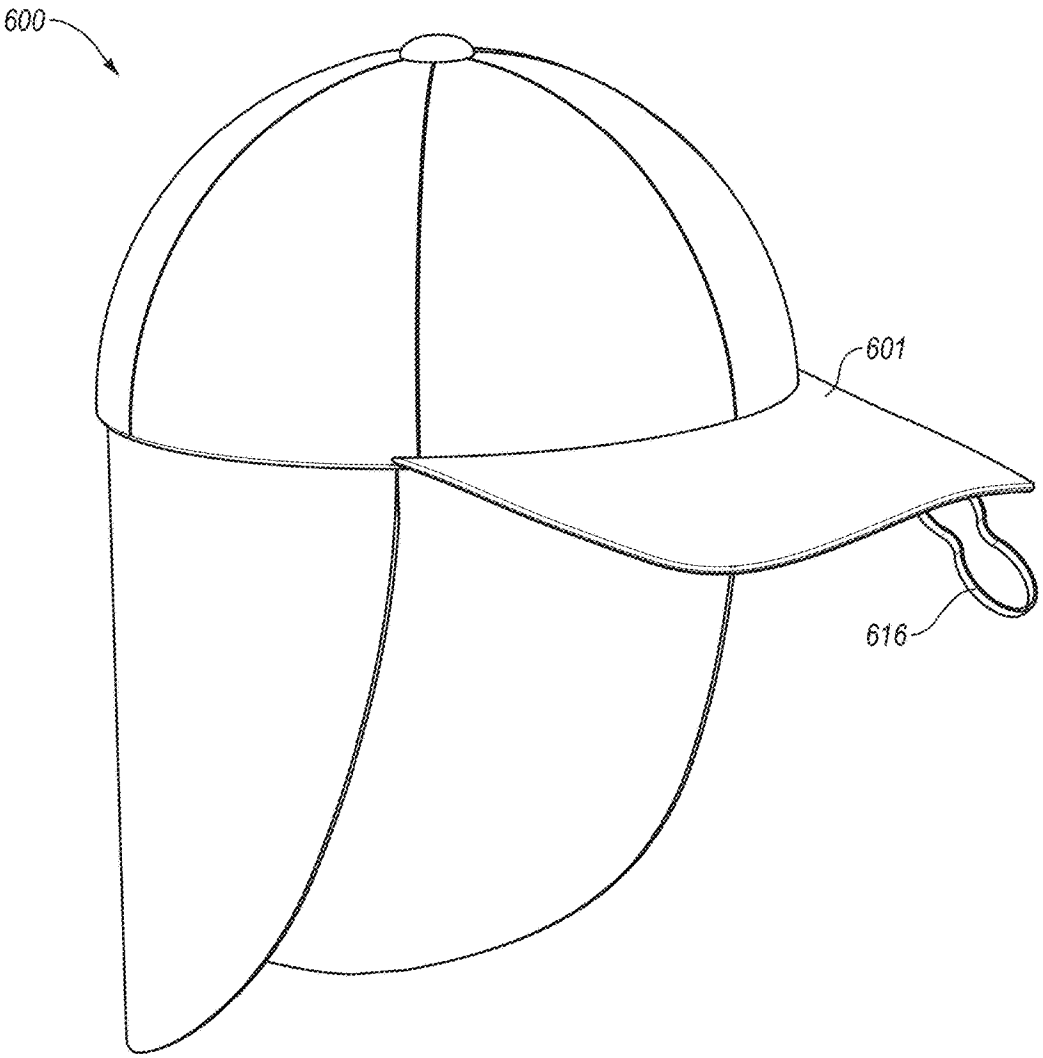
FIG. 6 illustrates another embodiment of a hat viewed from the side.

In addition to the fashion and protective features of hats, attendees of sporting events and other events may desire to display their support or enthusiasm in a variety of ways including swinging banners or flags. FIG. 6 depicts a hat 600 viewed from the side that may have one or more of the same features as the hat 100 and may include a finger loop 616 (also referred to as a "loop"). The loop 616 may be configured such that a finger may be placed within it. The loop 616 may also be configured to act as an anchor/pivot point about which the hat 616 may be swung or rotated in a, for example, three hundred-sixty degree motion, which may create a spinning, propeller type effect. Accordingly, in some embodiments, the hat 600 may be used during an outdoor event to not only provide protection from the elements, but also to be used as an element of providing support and/or showing enthusiasm. The loop 616 may be placed anywhere on the hat 600, the example depicted in FIG. 6 shows the loop 616 placed near the front of the bill 601.

Figure 7:
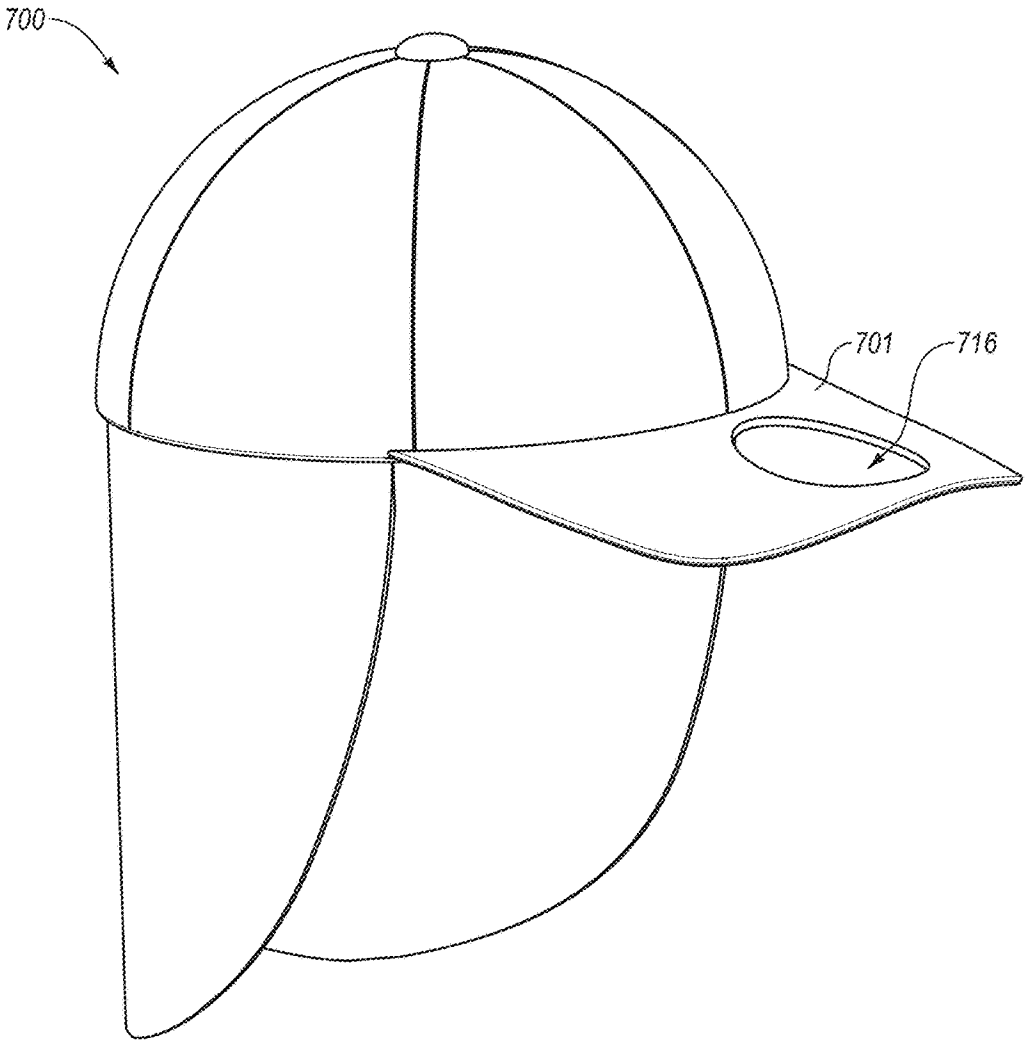
FIG. 7 illustrates another embodiment of a hat viewed from the side.

The loop 616 may be composed of any number of elements that may be sufficient to act as an anchor/pivot point about which the hat 616 may be swung or rotated. For example, FIG. 7 depicts a hat 700 viewed from the side that may include one or more of the same features as the hat 100 and a different example of a loop 716. In this embodiment, the loop 716 may be configured to include a void in a bill 701 of the hat 100 that may be configured to allow a finger, or the like, to be placed within it.

Figure 8:
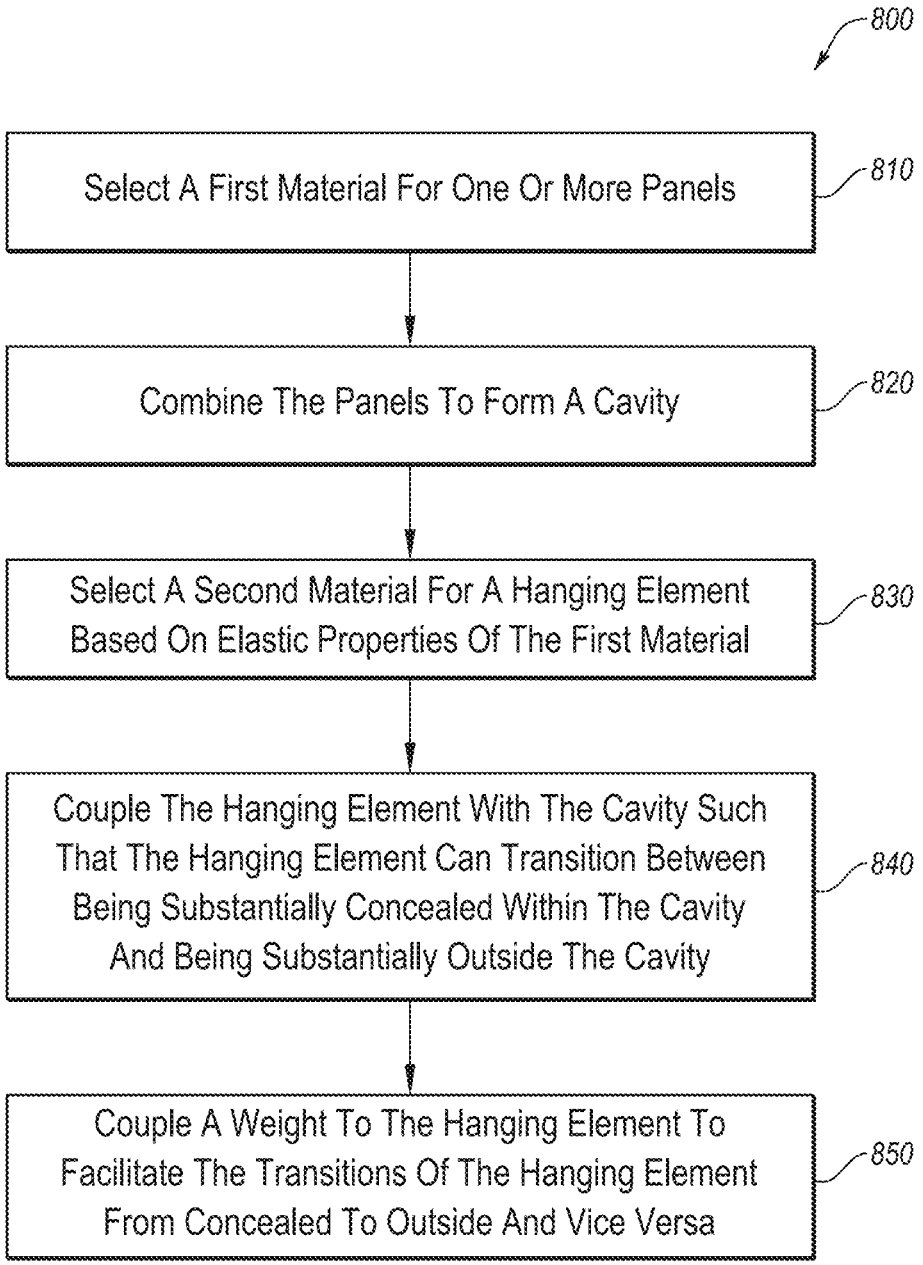
FIG. 8 illustrates an example method of manufacturing a hat.

FIG. 8 illustrates an example method 800 of manufacturing a hat in accordance with some embodiments of the present disclosure, for example, the hat 100 of FIGS. 1A-1C, the hat 200 of FIG. 2, the hat 300 of FIG. 3, the hat 600 of FIG. 6, and/or the hat 700 of FIG. 7. The method 800 may be performed by any suitable, system, apparatus, device, or operation (such as a manufacturing operation). Although illustrated with discrete blocks, the steps and operations associated with one or more of the blocks of the method 800 may be divided into additional blocks, combined into fewer blocks, or eliminated, depending on the desired implementation.

At block 810, a first material for one or more panels may be selected. For example, a material may be selected with an elastic property such that the material may expand from a resting length to approximately between 1.0 and 1.8 times the resting length. Any range and ratio of ranges may be used, for example approximately between 1.0 and 1.3 times the resting length. In some embodiments, the material may be selected based on, among other things, the elastic properties of the material such that the material may expand to support different sizes of heads of users (e.g. a "one-size fits most") while still maintaining enough elastic recoil that the hat stays securely on the head of the user wearing the hat. Additionally or alternatively, the material selection may also be based on the elastic properties such that the hat stays securely but is not uncomfortably tight on the head of the user. In some embodiments, some panels may be selected to have the first material and other panels may be selected to have an entirely different material. Additionally or alternatively, the panels may be treated or reinforced in some way as described in the present disclosure, or another material may be selected that may be reinforced. For example, by selecting a reinforced material or by reinforcing the material, the hat being manufactured may have additional rigidity to facilitate a hanging element transitioning to being substantially concealed within the hat and/or being comfortable to a user of the hat while the hanging element is substantially concealed within the hat. Additionally or alternatively, the rigidity of the material may facilitate the hat keeping or maintaining its shape as the hanging element transitions to being substantially disposed outside of the cavity.

At block 820, the panels are combined to form a cavity with an opening configured to receive the head of a user. The panels may be stitched together, glued, etc. In some embodiments, a single panel may be used and excess material may be removed or portions of the single panel may be stitched together to form the cavity. In some embodiments, the panels may be combined in a way or made of a material such that the volume of the cavity may change to accommodate various sizes of heads of users.

At block 830, a second material may be selected for a hanging element based on the elastic properties of the first material. For example, in some embodiments the second material may be selected to have the same or a similar elastic property to the first material. Additionally or alternatively, the second material may be selected to be less elastic than the first material or more elastic than the first material. In these and other embodiments, the first material and/or the second material may be selected such that, based on the elastic properties of the first material, the hanging element may transition from being substantially concealed within the cavity and substantially outside of the cavity and vice versa, even if the cavity has changed in size (e.g. expanded or constricted to change volume based on the elastic properties of the material). In these and other embodiments, the second material may also be selected to enhance comfort of a user of the hat. For example, a lightweight material, or sun-blocking material, or porous material (e.g. to allow wind), or a smooth material (e.g. one that is comfortable when in contact with skin), etc. may be selected. Additionally or alternatively, the second material may be selected based on a coloration or texture of the material, such as camouflage, etc.

At block 840, the hanging element may be coupled to the cavity such that the hanging element may transition from being substantially concealed within the cavity to being substantially outside of the cavity, and vice versa. Such transition may occur, for example, when a user flips the hat to cause the hanging element to transition from being outside of the cavity to being nested within the cavity. Such a transition may also occur, for example, when the user lifts the hat with the hanging element substantially inside of the cavity and shakes the hanging element out of the cavity such that it is substantially outside of the hat. In some embodiments, the coupling may include one or more ruffles, pleats, plaits, fold-overs, or combinations thereof in the first material and/or the second material. In these and other embodiments, the ruffles, pleats, plaits, fold-overs, or combinations thereof may be at least partially straightened out as the cavity expands due to the elastic properties of the first material and/or the second material.

At block 850, a weight may be coupled to the hanging element to facilitate the transitions of the hanging element. For example, a weight may provide additional momentum to an end of the hanging element when being flipped into the cavity. As another example, the weight may provide additional gravitational force to the end of the hanging element when it is shaken out of the cavity.

Accordingly, the method 800 may be used to manufacture a hat. Modifications, additions, or omissions may be made to the method 800 without departing from the scope of the present disclosure. For example, the operations of the method 800 may be implemented in differing order. Additionally or alternatively, two or more operations may be performed at the same time. By way of non-limiting examples, the block 820 and 830 may be done in a different order or concurrently, and the blocks 820 and 840 may be done in a different order or concurrently. Furthermore, the outlined operations and actions are provided as examples, and some of the operations and actions may be optional, combined into fewer operations and actions, or expanded into additional operations and actions without detracting from the essence of the disclosed embodiments. By way of non-limiting example, the block 850 may be omitted. All of the examples provided above are non-limiting and merely serve to illustrate the flexibility and breadth of the present disclosure.

All examples and conditional language recited herein are intended for pedagogical objects to aid the reader in understanding the present disclosure and the concepts contributed by the inventor to furthering the art, and are to be construed as being without limitation to such specifically recited examples and conditions. Although embodiments of the present disclosure present disclosure have been described in detail, it should be understood that the various changes, substitutions, and alterations could be made hereto without departing from the spirit and scope of the present disclosure.

What is claimed is:

1. A hat comprising:

a cavity with an opening configured to receive a head of a user;

one or more reinforced panels forming a first part of the cavity;

one or more unreinforced panels forming a second part of the cavity;

an adjustable band coupled to the one or more reinforced panels such that the adjustable band is disposed at least at the first part of the cavity proximate the opening of the cavity, the adjustable band being configured to adjust a volume of the cavity between a first volume and a second volume; and a hanging element specifically coupled to the adjustable band at the first part of the cavity based on the first part of the cavity being formed by the one or more reinforced panels, the coupling including stitching configured in a zig-zag pattern that allows the adjustable band to adjust between the first volume and the second volume, the hanging element having one or more expansion elements disposed proximate to the coupling in a manner that allows the hanging element to adjust as the adjustable band adjusts between the first volume and the second volume based on the one or more reinforced panels being reinforced, the hanging element being configured to:

cover one or more of a face of the user and a neck of the user;

be substantially concealed within the cavity at either the first volume or the second volume in which the coupling of the hanging element is offset from a rim of the opening such that, when the hanging element is substantially concealed within the cavity, the rim conceals a folded edge of the hanging element that is proximate the coupling;

be substantially disposed outside of the cavity at either the first volume or the second volume; and transition back and forth between being substantially concealed within the cavity and being substantially disposed outside of the cavity at either the first volume or the second volume.

2. A hat according to claim 1, wherein a first reinforced panel of the one or more reinforced panels includes a gradation of reinforcement, being more rigid proximate a center of the first reinforced panel and less rigid proximate an edge of the first reinforced panel.

3. A hat according to claim 1, the adjustable band including an elastic band.

4. A hat according to claim 1, wherein the one or more expansion elements are selected from a group consisting of: pleats and slits.

5. A hat according to claim 1, wherein the hanging element is disposed between the adjustable band and the one or more reinforced panels.

6. A hat according to claim 5, wherein the hanging element and the adjustable band are positioned relative to the cavity such that the hanging element is entirely concealed within the cavity.

7. A hat according to claim 1, wherein the hanging element is coupled at a front of the hat.

8. A hat according to claim 1, wherein the hanging element is coupled at a back of the hat.

9. A hat according to claim 1, wherein the hat is designed as one of a baseball hat, a cowboy hat, a beanie hat, or a boonie hat.

10. A hat according to claim 1, wherein the hat includes a loop configured to spin the hat around on the loop.

11. A hat according to claim 10, the hat further comprising:

a brim; and wherein the loop is one of attached to the brim or formed as a void in the brim.

12. A hat according to claim 1, wherein the hanging element further comprises a pocket.

13. A hat according to claim 12, wherein the pocket includes a weight configured to:

facilitate the hanging element transitioning from being substantially concealed within the cavity to being substantially disposed outside of the cavity; and facilitate the hanging element transitioning from being substantially disposed outside of the cavity to being substantially concealed within the cavity.

14. A hat comprising:

one or more reinforced panels and one or more unreinforced panels forming a cavity with an opening configured to receive a head of a user, the one or more reinforced and unreinforced panels being made of a material with an elastic property such that the one or more reinforced and unreinforced panels are configured to expand from a resting length to approximately 1.0 to 1.8 times the resting length of the one or more reinforced and unreinforced panels; and a hanging element coupled to the one or more reinforced panels, the coupling including stitching configured in a zig-zag pattern that allows the reinforced panels to transition between the resting length and the expanded length, the hanging element configured to, with the one or more reinforced panels at both the resting length and an expanded length, transition between being substantially concealed within the cavity and being substantially outside of the cavity, the coupling of the hanging element being offset from a rim of the opening such that, when the hanging element is substantially concealed within the cavity, the rim conceals a folded edge of the hanging element that is proximate the coupling, the hanging element being configured to cover one or more of a face of the user and a neck of the user.

15. A method of manufacturing a hat, the method comprising:

selecting a first material for one or more unreinforced panels of the hat;

selecting a second material for a hanging element based on elastic properties of the first material;

selecting a third material for one or more reinforced panels of the hat, the third material being reinforced;

forming the one or more unreinforced panels of the hat from the first material and the one or more reinforced panels of the hat from the third material;

combining the unreinforced panels and the reinforced panels to form a cavity with an opening configured to receive a head of a user;

selecting a size of the hanging element such that it is configured to cover one or more of a face and a neck of the user;

forming the hanging element out of the second material and according to the selected size of the hanging element; and coupling the hanging element to the one or more reinforced panels, such that the hanging element is configured to transition between being substantially concealed within the cavity and being substantially outside of the cavity, the coupling being offset from a rim of the cavity such that, when the hanging element is substantially concealed within the cavity, the rim conceals a folded edge of the hanging element that is proximate the coupling.

16. The method of claim 15, wherein the third material is selected to facilitate the hanging element transitioning between being substantially outside of the cavity and being substantially concealed within the cavity based on the reinforced nature of the third material.

17. The method of claim 15, wherein the first material, the second material, or both, are selected and used in manufacturing the hat based on the first material, the second material, or both being such that the configuration of the hanging element to transition between being substantially disposed within the cavity and being substantially outside of the cavity is maintained when a user adjusts the cavity in size.

18. The method of claim 15, wherein the second material is selected to have similar elastic properties as the first material.

19. The method of claim 15, wherein the elastic properties of the first material comprise expanding to between 1.0 and 1.8 times a resting length of the first material and the second material is selected to be less elastic than the first material.

20. The method of claim 19, wherein coupling the hanging element includes one or more ruffles, pleats, plaits, fold-overs, or combinations thereof in the hanging element such that as the one or more panels is stretched the one or more ruffles, pleats, plaits, fold-overs, or combinations thereof are at least partially straightened out.

21. The method of claim 15, wherein the elastic properties of the first material comprise expanding to between 1.0 and 1.3 times a resting length of the first material and the second material is selected to be more elastic than the first material.

22. The method of claim 21, wherein coupling the hanging element includes one or more ruffles, pleats, plaits, fold-overs, or combinations thereof in the one or more panels such that as the hat is adjusted in size, the one or more ruffles, pleats, plaits, fold-overs, or combinations thereof are at least partially straightened out.

23. The method of claim 15, further comprising coupling a weight to the hanging element, the weight configured to:

facilitate the hanging element transitioning from being substantially concealed within the cavity to being substantially outside of the cavity; and facilitate the hanging element transitioning from being substantially outside of the cavity to being substantially concealed within the cavity.

* * * * *